US006843691B1

(12) United States Patent
Jelten

(10) Patent No.: US 6,843,691 B1
(45) Date of Patent: Jan. 18, 2005

(54) SCULLING APPARATUS FOR SMALL BOATS

(76) Inventor: Jeffrey A. Jelten, 540 NW. 9th St., Corvallis, OR (US) 97330

( * ) Notice: Subject to any disclaimer, the term of this patent is extended or adjusted under 35 U.S.C. 154(b) by 0 days.

(21) Appl. No.: 10/603,221

(22) Filed: Jun. 25, 2003

(51) Int. Cl.[7] ..... B63H 1/36
(52) U.S. Cl. ..... 440/15; 440/21
(58) Field of Search ..... 440/13, 14, 15, 440/21

(56) References Cited

U.S. PATENT DOCUMENTS

| | | | | |
|---|---|---|---|---|
| 1,704,400 A | * | 3/1929 | Michiels | 440/4 |
| 2,365,415 A | * | 12/1944 | Kruse | 416/74 |
| 2,696,797 A | * | 12/1954 | Whidden | 440/14 |
| 2,809,604 A | * | 10/1957 | Meredith | 440/14 |
| 4,172,427 A | | 10/1979 | Kindred | |
| 4,304,555 A | | 12/1981 | Gander | |
| 4,345,903 A | | 8/1982 | Laser | |
| 4,389,196 A | | 6/1983 | Gander | |
| 4,548,149 A | | 10/1985 | Del Roso | |
| 5,584,732 A | | 12/1996 | Owen | |
| 6,079,344 A | | 6/2000 | Wang et al. | |

FOREIGN PATENT DOCUMENTS

| | | | |
|---|---|---|---|
| DE | 388 41 624 A1 | * | 9/1990 |
| FR | 2 446 765 | * | 8/1980 |

* cited by examiner

*Primary Examiner*—Sherman Basinger
(74) *Attorney, Agent, or Firm*—James F. Harvey, III

(57) ABSTRACT

The present invention provides an apparatus for propelling a small boat through a body of water by use of a sculling action. The apparatus may be comprised of a vertical stock attached to a vertical surface of the boat, normally the transom. A wide, flexible fin may project outwardly and rearwardly from the bottom end of the vertical stock. A tiller may extend from the top end of the vertical stock towards the bow of the boat. The pumping action on the tiller causes the fin to move back and forth in a sculling action so as to propel the boat through the water. The apparatus may be easily folded into a compact package for storage in the boat either for emergency use or for storage of the boat. The fin may be bifurcated into a plurality of panels for more compact and efficient storage. Plates provided to hold the fin in a vertical orientation may have flanges along their upper edges to provide a step for easy reentry of a swimmer into the boat.

14 Claims, 5 Drawing Sheets

SCULLING APPARATUS FOR SMALL BOATS

BACKGROUND OF THE INVENTION

The present invention relates to the manual propulsion of boats. More particularly, the invention relates to a foldable manual propulsion unit for mounting on a variety of small boats. Even more particularly, the present invention relates to a rudder-like unit that is clamped to the transom of a small boat in much the same way as an outboard motor.

Small boats have been used since the beginning of civilization for transportation over the water. Examples of such boats abound, e.g. dinghies, sailboats, inflatable boats, punts, lifeboats, and the like, and each type or style may have certain specialized uses for which it is well adapted. For example, some boats have shallow drafts to enable them to easily maneuver in swampy areas, whereas some have deeper drafts to allow them to manage in heavy waves. Some boats are inflatable for compact storage, minimum weight, and convenience. Still others may exhibit specialized features for activities such as fishing, scuba diving, or pleasure boating.

There are numerous methods of achieving movement of such boats over the surface of the water. These methods employ various devices that may be conveniently divided for purposes of discussion into mechanical devices (diesel or gasoline engines used to turn underwater screws or above-the-surface propellers), wind-powered devices (primarily utilized by different configurations of sail), and manual devices (oars or paddles). Manual devices are used either for both primary movement or as a backup whenever the primary movement method is unavailable. The most frequently encountered backup method consists of the use of oars or paddles since they are inexpensive, relatively light, and compact, depending upon the construction. They are also relatively quiet, do not require an external fuel source such as an engine requires, and do not depend upon environmental conditions as does a sail.

A number of techniques have been developed for using oars and paddles. Traditionally, oars have been employed in pairs, one for each hand, and inserted into pivoting oar locks on either rail of the boat. The oar locks serve as fulcrums for coordinated reciprocal motion of the oars by an oarsman. The flattened ends of the oars are dipped into the water and the boat is propelled by a pushing or pulling motion against the water by the oarsman. This action requires a sturdy platform to serve as the base for the oar locks and thus is most suitable for boats with rigid sides, the tops of which are relatively close to the water to allow the oars to be dipped therein without excessive upward reaching by the oarsman. Inflatable boats have much softer sides that are wider than those of rigid-sided boats; oar locks in the form of tabs having holes for the oars are sometimes sewn into the upper surfaces of such inflatable boats, but their use is generally awkward. One basic problem with this method of using oars is that the oarsman is generally in a position facing rearward to the direction of travel.

Another technique involves the use of a single oar, or paddle. In one variation, both hands of the oarsman are placed on the paddle, which is dipped into the water from a side of the boat. This method is favored for canoes and other light craft, but the sides must be sufficiently low and thin to allow the paddle to be inserted into the water without excessive reaching on the part of the oarsman. Paddles have been used to propel inflatable boats also, but the width of the side pontoon comprising the sides of an inflatable boat may require the oarsman to excessively reach out laterally, which may in turn cause premature fatigue. In another variation, the paddle or oar is mounted at the stem of a boat and worked from side to side to move the boat forward, much like the tail fin of a fish. For example, this method is employed by Venician gondoliers to propel the craft through narrow canals in Venice. Sculling is generally performed at the stern of the boat, although certain mechanical devices scull from amidships through the bottom of the boat, as will be seen presently.

Inflatable boats are quickly becoming the most popular small craft on the water. Their popularity is due in part to their affordability, stability, and comfort. Because of the problems discussed above, they are primarily propelled from the stem by an outboard motor. However, use of an outboard motor is often difficult or undesirable because of the weight and noise of the motor and the necessity for an accompanying gasoline tank, which takes up space within the craft. There is also the possibility of motor failure, which may leave occupant stranded. Paddles are often provided for emergency purposes, but, in order to save weight and space, they are generally flimsy and of insufficient length to enable them to be used for any significant period of time. Furthermore, they are difficult to use when mounted against the soft sides of the inflatable pontoons.

Paddles and oars do have another advantage over motors, in that they do not project downwardly in the water to any significant depth and, if they do encounter the bottom or some rigid object, they will yield before breaking. An outboard motor, on the other hand, rigidly projects a given depth below the bottom of the boat. When it encounters a rigid object, such as the floor of the body of water, either the pin holding the propeller will shear off to prevent damage to the propeller or the motor will kick back over the transom. Paddles and oars are more useful in such shallow situations.

Inflatable boats and other small craft have been particularly popular with scuba divers. During diving excursions, those participating in these underwater pastimes may easily enter the water by rolling off the sides of the pontoons of an inflatable boat. This method of entering the water is especially useful, given the heavy tanks and other equipment that the divers must carry. After a dive and upon reentering an inflatable or other small craft from the water, the divers are often fatigued and find it difficult to climb back into the boat. Small ladders of aluminum or rope construction are frequently used to assist the divers to reenter the boat. Such ladders do not work well on the sides of inflatable boats because of the lack of a stable platform for mounting and they do not work well at the more rigid stem because of the presence of motor or boat steering components.

Numerous devices have been proposed to implement the sculling method of propulsion with small boat. One such device consists of a vertically fin situated on a shaft projecting through the floor of the boat and under the bottom to propel and steer the boat in any direction. It has a horizontal arm mounted at the top of the shaft so that the shaft, and thus the fin, may be moved back and forth using either arm or leg power. The vertical fin is hinged to raise up without breaking when encountering an obstruction or the floor of the water way. This device is suited for rigid boat structures and must be permanently configured with the craft, since a water seal must be installed around the vertical shaft where it penetrates the bottom of the boat. Such devices are useful where portability and economy of space are not a criteria for use. One similar device uses pulleys rather than extending arms to actuate the fin. Another such device uses a tread system rather than pulley to transfer manual power from foot pedals to the vertical fin. At least one recreational lounging craft employs a sculling propulsion method that is actuated by foot power that oscillates a flexible fin to propel the device, but again, such devices are integral to the craft.

Thus, it can be seen that there is a need for a manual propulsion apparatus for small boats that is removable and portable. It should occupy a minimal amount of space when not installed and not in use, as when it is used as an emergency device rather than as the primary propulsion device. It should be adaptable for use with more than one design of boat, easy to operate for long periods of time, and downwardly adjustable for clearance in shallow water operation. Optionally, it should also provide a means for assisting persons in the water to reenter the boat.

SUMMARY OF THE INVENTION

A novel apparatus is provided for the propulsion of a small boat through the water, the actuating force for the apparatus being provided by manual effort on the part of the boat's occupant.

In one aspect of the invention, a sculling apparatus is provide for propelling a small boat through a body of water. The apparatus may comprise a vertical stock, an actuating means connected to the upper end of the vertical stock, a propulsion means connected to the bottom end of the vertical stock, and a mounting means for removably attaching the vertical stock to a generally vertical surface along the sides, bow, or stem of the boat. The actuating means and the propulsion means may be pivotably connected to the vertical stock so that they may folded against the vertical stock for compact and convenient storage and opened up into a deployed orientation when the apparatus is installed for operation.

In another aspect of the invention, the sculling apparatus may be provided with a tiller to serve as the actuating means, wherein the tiller transmits back and forth radial motion through the vertical stock to the propulsion means.

In another aspect of the invention, the sculling apparatus may be provided with a collapsible fin serving as the propulsion means, where the fin is configured as two separate panels that foldably pivot against the vertical stock for compact and convenient storage.

In another aspect of the invention, the fin panels may be comprised of a resilient material, such as rubber, polyethylene, polypropylene, or wood, so that the unattached end of the fin is allowed to flex as the fin is actuated and the pivotably attached end of the fin is rigidly held.

In another aspect of the invention, the means for rigidly holding the fin in pivotable relationship with the vertical stock may comprise a vertical and parallel pair of plates attached to the lower end of the vertical stock, the plates having a pin inserted therethrough to serve as the horizontal axis for pivotable rotation of the fin.

In another aspect of the invention, the plates serving as the means for rigidly holding the fin may each have an outwardly extending flange to serve as a step when the fin is operationally deployed, the step disposed to enable a person in the water to place a foot thereon in order to assist the person in leveraging himself out of the water and into the boat.

In another aspect of the invention, the vertical stock may be provided with a displacement control means for selectively adjusting the distance that the lower end of the vertical stock extends into the water when the apparatus is removably attached to the boat, so that the vertical stock may be extended sufficiently to allow the propulsion means to pass beneath the bottom of the boat when the vertical stock is rotated through a 360° arc.

In yet another aspect of the invention, the displacement control means may comprise an adjustable collar encircling a first bushing which receives the vertical stock inserted therethrough, the adjustable collar and first bushing adjustably secured to the vertical stock and positioned by the mounting means between a second and third bushing that also receive the vertical stock therethrough, wherein the second and third bushing prevent longitudinal movement of the vertical stock when the adjustable collar and first bushing are secured thereto, and wherein the vertical stock may move freely through the first, second, and third bushings when the adjustable collar is not secured to the vertical stock.

These and other features, aspects and advantages of the present invention will become better understood with reference to the following drawings, description and claims. For a better understanding of the invention, its operating advantages and the specific objects attained by its uses, reference should be made to the accompanying drawings and descriptive matter in which there are illustrated preferred embodiments of the invention. The foregoing has outlined some of the more pertinent aspects of the invention. These aspects should be construed to be merely illustrative of some of the more prominent features and applications of the present invention. Many other beneficial results can be attained by applying the disclosed invention in a different manner or by modifying the invention within the scope of the disclosure. Accordingly, other aspects and objects may be discerned from a fuller understanding of the invention and the detailed description of the preferred embodiments in addition to the scope of the invention illustrated by the accompanying drawings.

The accompanying drawings, which are incorporated in and constitute a part of the specification, illustrate a preferred embodiment of the invention and, together with a general description given above and the detailed description of the preferred embodiment given below, serve to explain the principles of the invention

DETAILED DESCRIPTION OF THE INVENTION

The following detailed description shows the best currently contemplated modes of carrying out the invention.

The description is not to be taken in a limiting sense, but is made for the purpose of illustrating the general principles of the invention and the best mode for practicing the invention, since the scope of the invention is best defined by the appended claims.

The sculling apparatus may be comprised a vertical stock having an actuating means pivotably attached to its upper end and a propulsion means pivotably attached to its lower end, the entire apparatus attached to a generally vertical surface of a small boat. The apparatus is designed to be folded into a compact, convenient package so that it may be either stowed in an out-of-the-way compartment for possible emergency use or placed in a mounted position on the vertical surface for rapid deployment if necessary and without interfering with any other apparatus that may require use of the vertical surface. The sculling apparatus may also provide a steering function as well as a sculling function when mounted on the transom of a boat. The apparatus may be provided with a displacement control means to permit the apparatus to be longitudinally raised completely out of the water or to be inserted into the water to a depth allowing the propulsion means to pass beneath the bottom of the boat when the actuating means is rotated through a 360° arc, thus allowing the boat to be maneuvered within a tight turning radius. When the apparatus is in the water and the propulsion means is in a deployed position, a step means may be provided to allow a person in the water for diving or swimming to conveniently reenter the craft by using the step means as a leverage point to step into the craft.

In a preferred embodiment, the actuating means may comprise a tiller and the propulsion means may comprise a fin, both of which may be attached to opposing ends of a common vertical axis defined by the vertical stock, as will be seen presently. The operator of the apparatus may sit in the craft facing the direction of travel and pump the tiller back and forth through a horizontal plane and about a vertical axis, thus propelling the craft through the water. Unlike rowing, this process allows the operator to face in the direction the boat is traveling and may be accomplished with only one hand. Furthermore, the apparatus is light and quiet and takes up very little room for storage within the craft.

Figure 1:
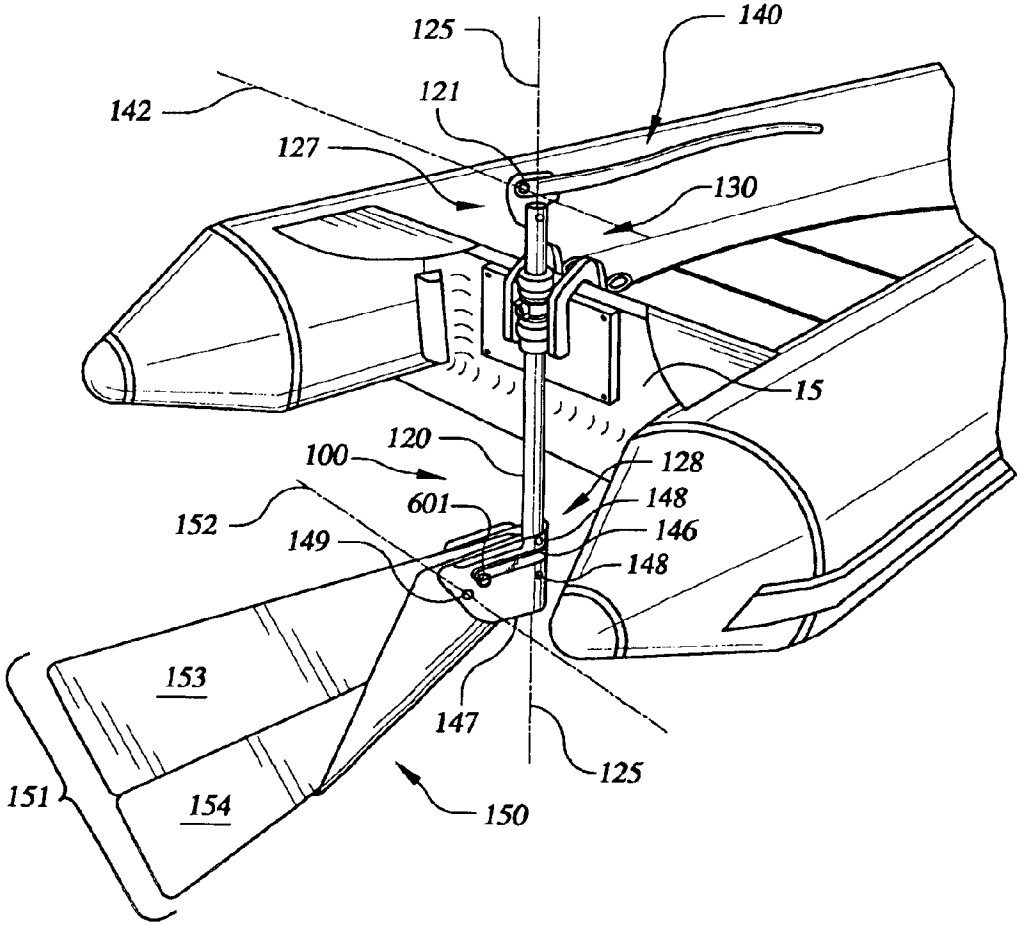
FIG. 1 is a perspective view of the invention in deployed orientation when mounted on a generally vertical transom of a small boat, according to an embodiment thereof.

An embodiment 100 of the invention is disclosed in FIG. 1, showing the stem of a small boat 10 with the embodiment 100 mounted thereon. Vertical stock 120 may be supported on a vertical surface of the boat 10 by a mounting means 130. Although any suitable vertical surface along the sides of the boat may be used depending upon the boat design, the vertical surface shown in FIG. 1 is represented by the transom 15 of the boat. As shown, mounting means 130 may be comprised of a dual clamp arrangement in which the clamp rests on the top edge of the transom 15 and captures the transom 15 between a fixed portion of the clamp and a moveable hand screw, in a manner similar to that conventionally used to mount an outboard motor. Although a clamp arrangement is shown, any suitable method may be used that allows the vertical stock 120 to be vertically supported for radial motion about a vertical axis 125. For example, a standard gudgeon and pintle arrangement typically used to removably mount rudders to the transoms of small sailboats may also be used.

At the upper end 127 of vertical stock 120 may be pivotably attached an actuating means 140 that may pivot in a vertical plane about horizontal axis 142 and in a horizontal plane about the vertical axis 125. As shown in FIG. 1, the actuating means 140 is a standard tiller 141 typically used on sailboats and the like. The tiller 141 is pivotably attached to the vertical stock by a pin 121 inserted through tiller 141 and the upper end 127 of vertical stock 120. Although a tiller 141 is preferred, other actuating means 140 may be used to impart radial motion to the vertical stock 120 without departing from the scope of the invention, such as, for example, a horizontal bar with stirrups for a pair of feet.

Figure 6:
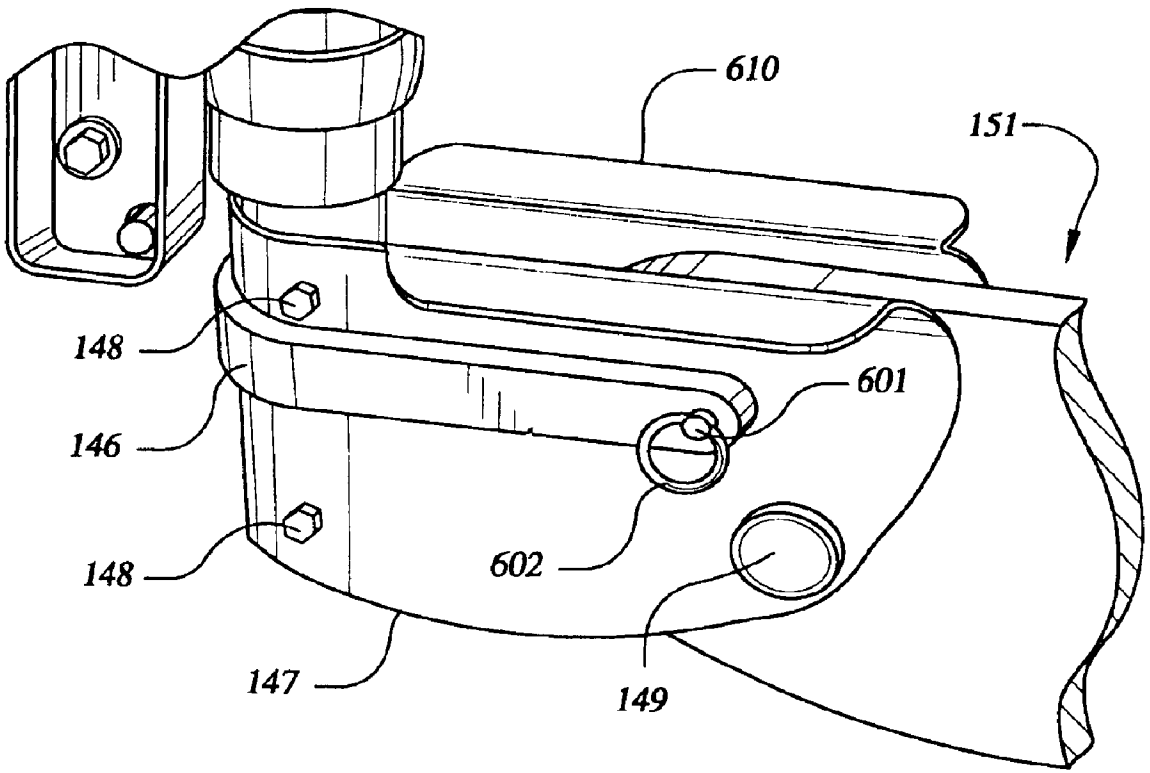
FIG. 6 is a perspective view of illustrating the step means and the method of locking the fins in a deployed position, according to an embodiment of the invention.

A propulsion means 150 may be pivotably attached to the lower end 128 of vertical stock 120, so that it may pivot in a vertical plane about horizontal axis 152, comprised of a fixed pin 149, and in a horizontal plane about vertical axis 125. As shown in FIG. 1 and FIG. 6, the propulsion means 150 is a fin 151, and preferably, a bifurcated fin having an upper panel 153 and a lower panel 154 disposed so that they may each independently pivot vertically about fixed pin 149. The fin 151 is attached to the lower end 128 by a bracket 147. The bracket 147 may be constructed as a plate bent around the lower end 128 to capture the fin 151 between its ends and fixed to the lower end 128 by bolts 148. A leaf spring 146 may be inserted over the bracket 147 to provide additional support for the fin 151. It may also serve as a support for a locking pin 601 for locking the fin 151 into an given position, as will be described presently.

Figure 2:
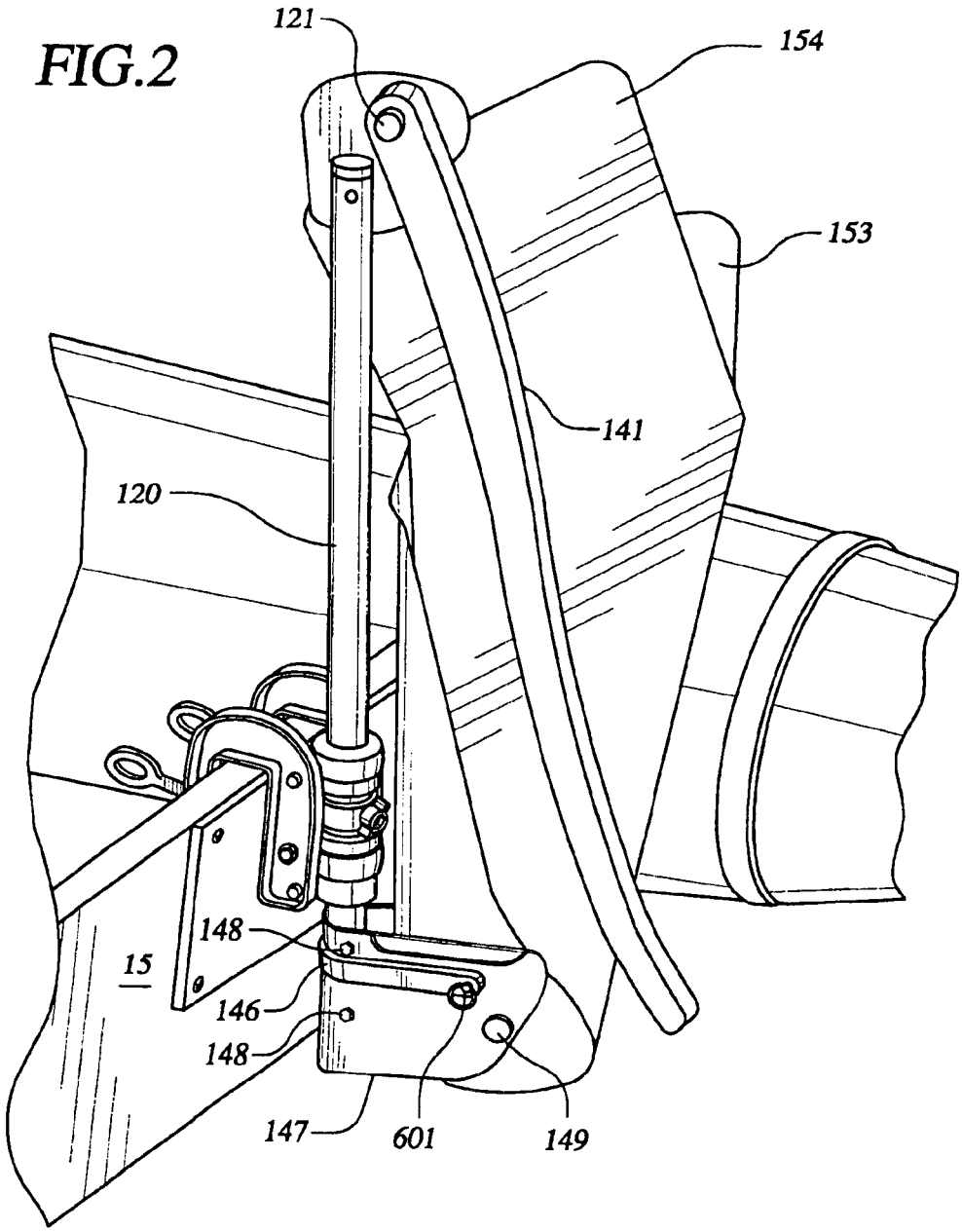
FIG. 2 is a perspective view of the invention in folded orientation while still mounted on the transom of a small boat, according to an embodiment thereof.
Figure 3:
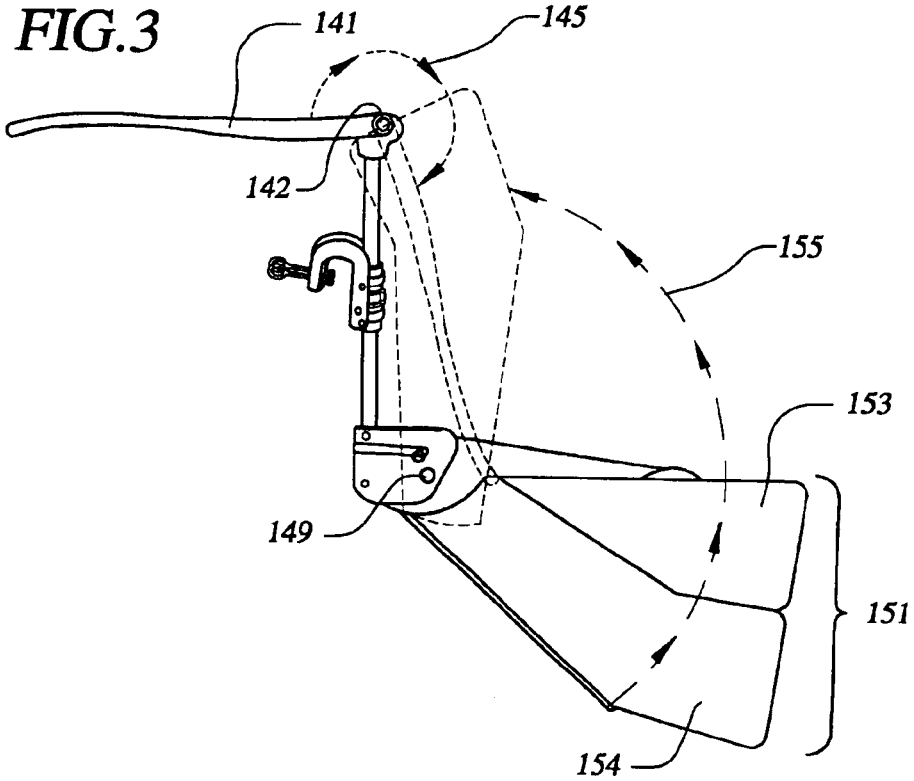
FIG. 3 is a side plan view of the invention illustrating its components and the manner in which it may be folded for compact and convenient storage, according to an embodiment thereof.

Referring to FIG. 3, the operational configuration of the tiller 141 and the fin 151 is shown, and the folded configuration of the tiller 141 and fin 151 is shown in phantom. The tiller 141 may be pivoted clockwise in the direction 145 shown and the panels 153, 154 of the fin may be pivoted counterclockwise in the direction 155 shown, so that the folded configuration shown in phantom is achieved. Note that these pivoting operations may be performed independently of one another and that they may be performed whether or not the apparatus is mounted to a vertical surface. The folded configuration is shown in FIG. 2.

Figure 4:
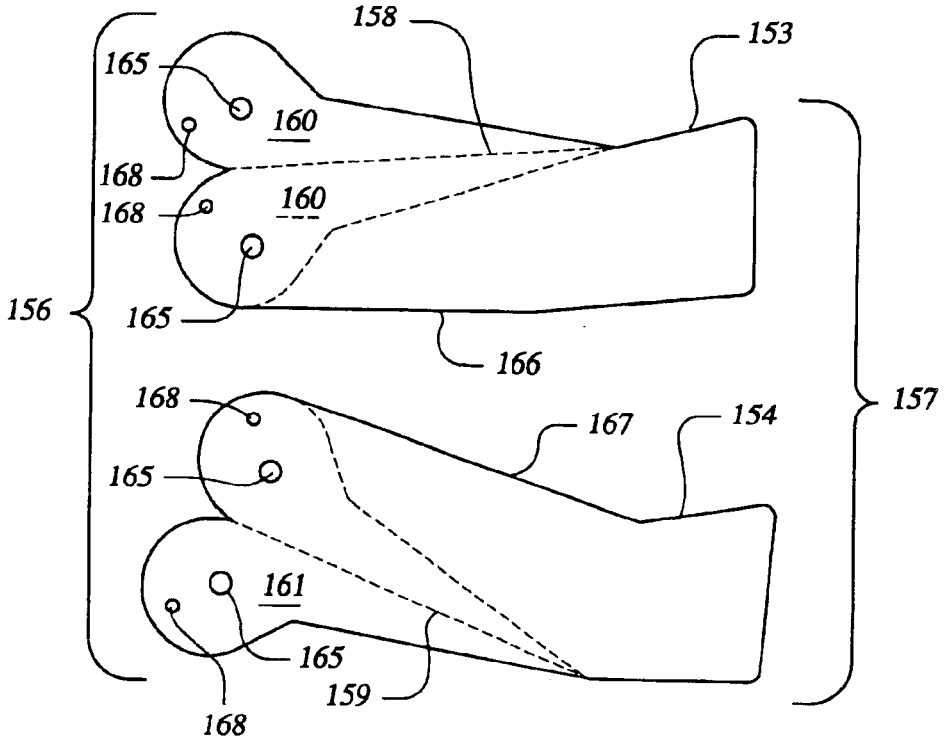
FIG. 4 illustrates the templates that may be used to construct an upper and lower panel to serve as a fin for an embodiment of the invention.

Referring now to FIG. 4, each of the panels 153, 154 comprising fin 151 may be constructed of any resilient material that allows the trailing edges 157 to flex during operation. Such resilient materials may comprise rubber, wood, polyethylene, polypropylene, or any suitable material that can be cut from a sheet, as shown in FIG. 4, with polyethylene being preferred. For proper operation of the apparatus, the trailing edges 157 may be allowed to flex against the resistance of the water, while the leading edges 156 may be more rigid to support the fin 151 during operation. This rigidity may be achieved by doubling the fin material at the leading edge 156 according to the pattern depicted in FIG. 4 so that interlocking pockets are formed in each of the panels 153, 154. The upper panel 153 may be cut from a sheet of polyethylene as shown, and the portion 160 folded along fold line 158 under panel 153 as viewed in the figure. When folded, a pocket of material is formed between portion 160 and panel 153. Similarly, the lower panel 154 may be cut according to the pattern shown, and the portion 161 is folded along fold line 159 over panel 154 as viewed in the figure to form a pocket of material between portion 161 and panel 154. Pivot holes 165 are made in the material to accommodate the pin 149 representing horizontal axis 152 about which the panels will pivot. Similarly, locking holes 168 are provided for removable insertion of the locking pin 601, so that the fin 151 may be fixed in various positions. Two sets of locking holes 168 may be preferably provided, one set to hold the fin 151 in a folded position and the other set to hold the fin 151 in a deployed, or fully extended, position. For clarity, only one set of locking holes 168 is shown to indicate their general positioning. When in the folded configuration, edge 166 will nest in the pocket formed by portion 161 and panel 154, and edge 167 will nest in the pocket formed by portion 160 and panel 153.

Figure 5:
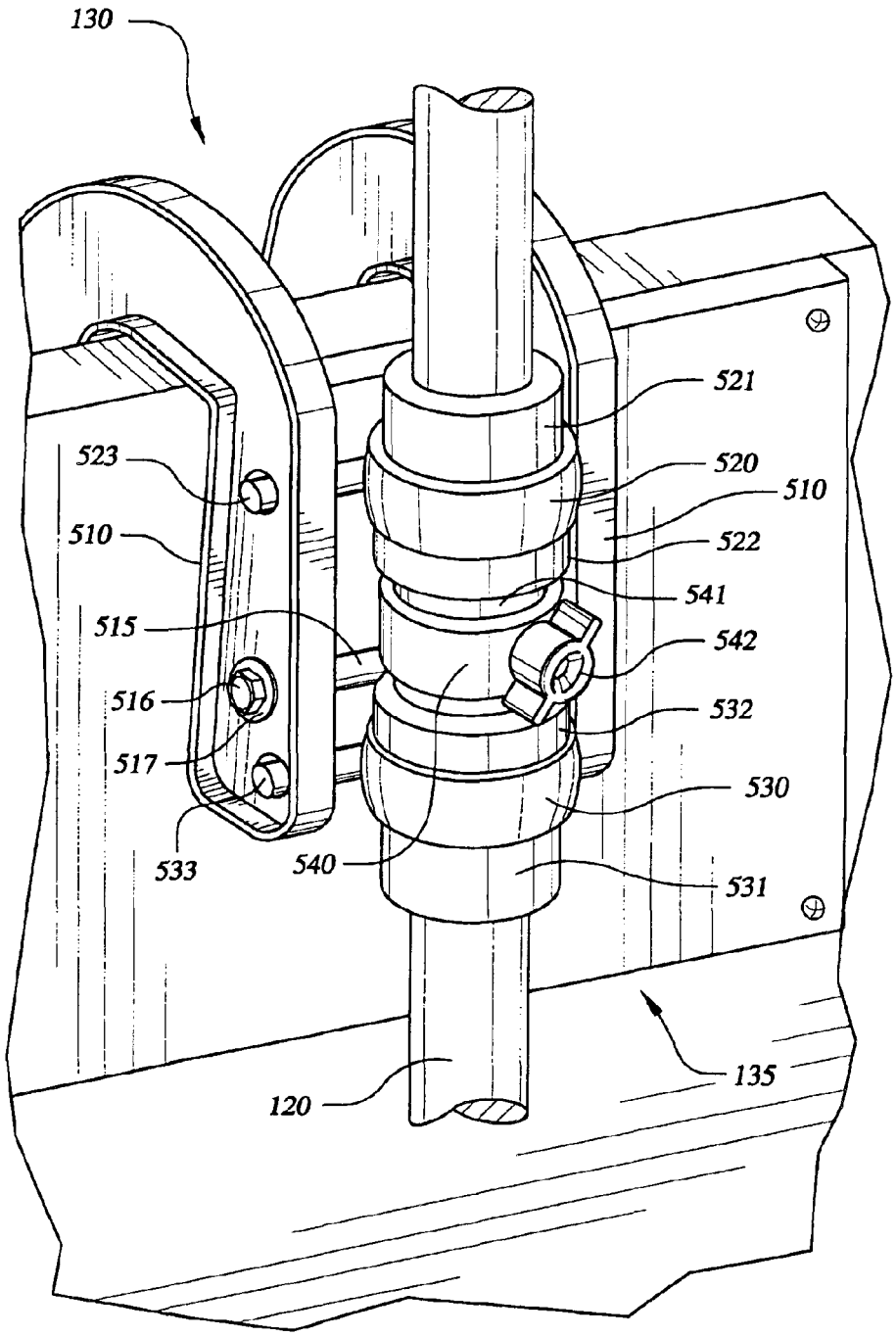
FIG. 5 is a perspective view of the invention illustrating in more detail the displacement control means, according to an embodiment thereof.

Referring now to FIG. 5, an embodiment of the displacement control means 135 and its relationship to the mounting means 130 may be seen. The mounting means 130 may comprise a plurality of standard C-clamps 510 held in a fixed and spaced relationship with each other so that the displacement control means 135 and the vertical stock 120 may be arranged therebetween. Any suitable method of arranging the C-clamps 510 in spaced relationship may be used. As shown, a single rectangular bar 515 is bolted to the C-clamps 510 using a hex bolt 516 and washer 517 inserted through opposing holes in the C-clamps 510 to fix the an end of the bar 515 to a respective C-clamp 510. Although a single bar 515 is shown, one or more such bars may be used to ensure stability of the apparatus. Other methods well known to the art may also be used to space the C-clamps 510, such as use of a plate to which the C-clamps are welded or a plurality of plates welded to the outer edge of the clamps.

The displacement control means 135 controls the height of the vertical stock 120 with relationship to the mounting means 130 and thus to the vertical side of the boat to which it is mounted. In the embodiment shown, the displacement control means 135 may comprise an upper fixed ring 520 and a lower fixed ring 530 with an adjustable collar 540 therebetween, with the vertical stock 120 passing through fixed ring 520, collar 540, and fixed ring 530. The rings 520, 530 and collar 540 may be constructed of any suitable material such as plastic or metal that can withstand the corrosive effect of a damp environment, with stainless steel being preferable. The upper fixed ring 520 is affixed to a horizontal rod 523 which holds the ring 520 in a generally horizontal orientation. The horizontal rod 523 is loosely inserted through holes in the C-clamps 515 to maintain spacing between the upper fixed ring 520 and the lower fixed ring 530. Similarly, the lower fixed ring 530 is affixed to a horizontal rod 533 which holds the ring 530 in a generally horizontal orientation. The horizontal rod 533 is also loosely inserted through holes in the C-clamps 515. The rings 520, 530 may be affixed to respective rods 523, 533 by any manner well known to the art, such as by welding, braising, screws, rivets, and the like.

An upper bushing 521 having an upper bushing flange 522 is inserted through the upper fixed ring 520 and around the vertical stock 120 to guide the vertical stock 120 through both rotational movement and longitudinal movement. Similarly, a lower bushing 531 having a lower bushing flange 532 is inserted through the lower fixed ring 530 and around the vertical stock 120 to also guide the vertical stock 120 through both rotational and longitudinal movement. The flanges of the bushings 521, 531 are inserted so that they oppose one another, with the upper bushing flange 522 in contact with the lower surface of upper fixed ring 520 and with the lower bushing flange 532 in contact with the upper surface of the lower fixed ring 530. A middle bushing 541 is inserted between the flanges 522, 532 and around vertical stock 120 to both maintain the bushings 521, 531 against their respective fixed rings 520, 530 and to support the adjustable collar 540. A set screw (not shown) having a knob 542 may be inserted through adjustable collar 540 and middle bushing 541 so that the adjustable collar 540, may be firmly connected to vertical stock 120 to prevent longitudinal movement of the vertical stock 120 therethrough. When the set screw is tightened so that the adjustable collar 540 and middle bushing 541 are fixed in place on the vertical stock 120, then longitudinal movement of the vertical stock 120 is prevented by middle bushing 541 being captured between flanges 522, 532. Alternatively, the adjustable collar 540 may have a vertical gap (not shown) so that two arms are formed, with a screw arrangement attached to either arm and used to tighten the arms against the bushing 541, much like a clamp. Other methods of securing the adjustable collar 540 and bushing 541 which may be obvious to those skilled in the art, based upon the previously described function, may be employed to prevent longitudinal movement of the vertical stock 120.

FIG. 6 shows in greater detail how the bracket 147 may be configured. Locking pin 601 may be removably inserted through coaxial holes in the leaf spring 146 and the bracket 147. Locking pin 601 may be provided with a ring 602 so that the locking pin 601 may be more easily engaged by a person's finger. When the locking pin 601 is pulled out by means of the ring 602, the fin 151 is allowed to vertically pivot about pin 149. When the appropriate set of locking holes 168 (FIG. 4) are aligned with the locking pin 601, then locking pin 601 may be inserted therethrough to prevent further pivoting motion of the fin 151 about its pivot pin 149. Locking pin 601 may be loosely affixed to the leaf spring 146 by any conventional means known to the art, so that it may not be inadvertently lost in the water. An upper flange 610 is provided on the upper edge of bracket 147 to serve as a step point to allow a person in the water to gain access to the boat without bending or otherwise damaging the fin 151. As shown, the upper flange 610 is constructed as a tab upwardly extending from the bracket 147 and horizontally bent to form the step. However, other methods of forming a step to the upper edge of bracket 147 may also be employed without departing from the scope of the invention, as, for example, affixing a horizontally oriented strip of metal sheet to the upper edge of bracket 147 as by welding, screws, rivets, or other standard method of joining items.

As has been demonstrated, the present invention provides an advantageous apparatus for sculling a small boat. While the preferred embodiments of the present invention have been described, additional variations and modifications in those embodiments may occur to those skilled in the art once they learn of the basic inventive concepts. Therefore, it is intended that the appended claims shall be construed to include both the preferred embodiment and all such variations and modifications as fall within the spirit and scope of the invention.

I claim:

1. A sculling apparatus for propelling a boat through a body of water, the boat having a generally vertical and rigid surface with a top edge along the boat's perimeter, the apparatus comprising a vertical stock with an upper end and a lower end, the vertical stock centered about a vertical axis;

a mounting means supporting the vertical stock for radial movement about the vertical axis and providing removable attachment of the vertical stock to the rigid vertical surface of the boat;

an actuating means enabling a human to impart radial movement to the vertical stock about the vertical axis, the actuating means pivotably connected about a first horizontal axis to the upper end, wherein the actuating means may be pivoted from a first position for operational deployment to a second position generally adjacent to the vertical stock for compact storage when not operationally deployed; and a fin comprised of a plurality of overlapping panels attached to the lower end, each panel independently pivotable about a common second horizontal axis extending through both the lower end and the panels, wherein the plurality of panels may be pivoted from a third position extending generally horizontally from the lower end for operational deployment to a fourth position generally adjacent to the vertical stock for compact storage when not operationally deployed.

2. The apparatus described in claim 1 wherein the fin is comprised of an upper panel and a lower panel, each panel having a flexible end and a stiff end, the stiff ends pivoting about the second horizontal axis.

3. The apparatus described in claim 2, wherein the fin is comprised of a resilient material.

4. The apparatus described in claim 3, wherein the resilient material is selected from a group consisting of rubber, polyethylene, polypropylene, and wood.

5. A sculling apparatus described in claim 1, wherein the plurality of overlapping panels is frictionally captured between a pair of plates forming a portion of the lower end, the second horizontal axis extending through the panels and the plates.

6. A sculling apparatus for propelling a boat through a body of water, the boat having a generally vertical and rigid surface with a top edge along the boats perimeter, the apparatus comprising a vertical stock with an upper end and a lower end, the vertical stock centered about a vertical axis;

a mounting means supporting the vertical stock for radial movement about the vertical axis and providing removable attachment of the vertical stock to the rigid vertical surface of the boat;

an actuating means enabling a human to impart radial movement to the vertical stock about the vertical axis, the actuating means pivotably connected about a first horizontal axis to the upper end, wherein the actuating means may be pivoted from a first position for operational deployment to a second position generally adjacent to the vertical stock for compact storage when not operationally deployed; and a fin attached to the lower end and pivotable about a second horizontal axis, the fin attached to the vertical stock by a bracket, the bracket comprising two parallel plates extending from the vertical stock in a generally perpendicular orientation, the second horizontal axis passing through the two parallel plates so that the fin is frictionally captured therebetween when pivotably rotated about the second horizontal axis, each plate with a horizontal flange along an upper extent of plate, the flange extending outwardly from the fin;

wherein the fin may be pivoted from a third position extending from the lower end in an orientation generally perpendicular to the vertical stock when operationally deployed to a fourth position generally adjacent to the vertical stock for compact storage when not operationally deployed, and wherein the flanges form a step disposed to enable a person in the water to place a foot thereon in order to assist the person in leveraging himself out of the water and into the boat.

7. The apparatus described in claim 6, wherein the actuating means is a tiller and the first position comprises the extension of the tiller in a generally perpendicular orientation from the upper end of the vertical stock.

8. The apparatus described in claim 6, wherein the mounting means comprises a clamp for removable attachment of the apparatus to the top edge of the vertical surface.

9. The apparatus described in claim 6, wherein the vertical surface is the transom of the boat.

10. The apparatus described in claim 6, wherein the apparatus further comprises a displacement control means for selectively adjusting the depth of the lower end beneath a surface of the body of water when the apparatus is mounted on the boat.

11. The apparatus described in claim 10, wherein the displacement control means comprises a bushing receiving the vertical stock inserted therethrough, the bushing adjustably secured to the vertical stock and supported by the mounting means between a pair of stops on the mounting means, wherein the bushing, when the bushing is adjustably secured to the vertical stock, moves radially when the vertical stock moves radially but prevents the vertical stock from being raised or lowered with respect to the mounting means.

12. A sculling apparatus for propelling a boat through a body of water, the boat having a generally vertical surface with a top edge, the apparatus comprising a vertical stock with an upper end and a lower end, the vertical stock centered about a vertical axis;

a tiller pivotably connected about a first horizontal axis to the upper end, the tiller pivotable from a first position for operational deployment to a second position generally adjacent to the vertical stock for compact storage when not operationally deployed, the first position orienting the tiller in a horizontal plane generally perpendicular to the vertical shaft so that radial tiller movement imparts radial movement to the vertical stock about the vertical axis;

a flexible fin comprising two overlapping panels, the fin captured between two parallel plates fixedly attached to the lower end and extending in a generally perpendicular direction from the lower end, the fin pivotably attached about a second horizontal axis passing through the plates and the panels so that the plates frictionally capture the fin therebetween, wherein the fin may be pivoted from a third position for operational deployment to a fourth position generally adjacent to the vertical stock for compact storage when not operationally deployed; and a mounting assembly supporting the vertical stock, the mounting assembly comprising a clamp for removably attaching the vertical stock to an upper edge of a rigid surface of the boat, the clamp permitting radial movement of the vertical stock about the vertical axis, the mounting assembly further comprising a bushing through which the vertical stock passes, the bushing adjustably attached to the vertical stock to allow selective displacement of the lower end of the vertical stock.

13. A sculling apparatus described in claim 12, wherein plurality of panels is comprised of two panels, each panel independently pivoting about the second horizontal axis.

14. A sculling apparatus described in claim 12, wherein each of the plurality of parallel plates has an outwardly turned flange along an upper edge of each plate, wherein the flange may be used as a step enabling a person in the water to place a foot thereon and leverage himself out of the water into the boat while the fin is deployed in the third operational position.

* * * * *